US005630475A

United States Patent [19]

Sabin et al.

[11] Patent Number: 5,630,475

[45] Date of Patent: May 20, 1997

[54] DEVICE FOR PRESSURIZING A PLATE BUNDLE, ESPECIALLY FOR A PLATE HEAT EXCHANGER

[75] Inventors: Dominique Sabin, Herbeville; William Levy, Paris; Emmanuel Martin, Le Mesnil St Denis, all of France

[73] Assignees: Framatome, Courbevoie; Packinox, Paris, both of France

[21] Appl. No.: 431,087

[22] Filed: Apr. 28, 1995

[30] Foreign Application Priority Data

Apr. 29, 1994 [FR] France ..... 94 05270

[51] Int. Cl.[6] ..... G05D 23/00

[52] U.S. Cl. ..... 165/281

[58] Field of Search ..... 165/31, 34

[56] References Cited

U.S. PATENT DOCUMENTS 4,167,968 9/1979 Wietelmann .

FOREIGN PATENT DOCUMENTS

A1575395 7/1969 France .
A2131791 11/1972 France .
A2471569 6/1981 France .

OTHER PUBLICATIONS

Preliminary Search Report, Jan. 19, 1995, Republique Francaise Institut National de la Propriete Industrielle.

*Primary Examiner*—Edward K. Look
*Assistant Examiner*—Mark Sgantzos
*Attorney, Agent, or Firm*—Pollock, Vande Sande & Priddy

[57] ABSTRACT

A device for pressurizing a plate bundle which is arranged in a leakproof vessel (2) and comprises a stack of plates which are parallel to one another to form a first circulation circuit for a first fluid under pressure and a second circulation circuit for a second fluid under pressure. The device includes a first conduit (15) for connecting the vessel (2) to the delivery (10) of the first fluid continuously feeding the vessel (2), a second conduit (16) for connecting the vessel (2) to the delivery (12) of the second fluid feeding the vessel (2) in the event of stoppage of the delivery of the first fluid, and controls (20) for feeding of the vessel (2) with the second fluid.

9 Claims, 4 Drawing Sheets

DEVICE FOR PRESSURIZING A PLATE BUNDLE, ESPECIALLY FOR A PLATE HEAT EXCHANGER

FIELD OF THE INVENTION

The present invention relates to a device for pressurizing a plate bundle, especially for a plate heat exchanger.

BACKGROUND OF THE INVENTION

In certain fields of application such as, for example, the liquefaction of natural or synthetic gas of low boiling point, installations, are known in which the condensation of the gas at high pressure and at low temperature and then the supercooling of the liquefied gas at high pressure are obtained by passing through cryogenic generators, followed by the expansion of the gas as a continuous flow through a pressure-reducer in order to collect the liquefied gas, for example in a low-pressure receptacle.

The cryogenic generators generally consist of bundles of coiled tubes which have the disadvantage of being large in size and relatively costly.

Other known installations employ plate bundles arranged in a leakproof vessel and comprising a stack of plates which are parallel to one another to form a first circulation circuit for the gas under pressure and a second circulation circuit for a liquid under pressure, concurrent with the first circuit.

To avoid damaging the plate bundle, the latter must be blocked either by an external pressure which is higher than or equal to the highest pressure capable of existing in the plate bundle or by a mechanical pressurization such as a sheet-and-tie-rods assembly, or by a combination of both these systems.

Thus, all the operating conditions, i.e., normal operation, start-up, shutdown and the exceptional cases of operation, must be envisaged so as to guarantee the mechanical behavior of the plate bundle.

SUMMARY OF THE INVENTION

The objective of the invention is to propose a device for pressurizing a plate bundle, which makes it possible to ensure its mechanical behavior under all operating conditions.

This object is attained by means of a device for pressurizing a plate bundle, especially for a plate heat exchanger, the plate bundle being arranged in a leakproof vessel and comprising a stack of metal plates which are parallel to one another to form a first circuit for circulating a first fluid under pressure and a second circuit for circulating a second fluid under pressure.

The first fluid is a higher pressure than the second fluid, and the device includes a first conduit for connecting the vessel to the delivery of the first fluid continuously feeding the vessel, a second conduit for connecting the vessel to the delivery of the second fluid feeding the vessel in the event of stoppage of the feed of the first fluid and means for controlling the feeding of the vessel with second fluid.

According to other characteristics of the invention:

the means of control comprise a nonreturn valve fitted in the first conduit for connecting the vessel to the delivery of the first fluid, and a controlled valve fitted in the second conduit for connecting the vessel to the delivery of the second fluid, the controlled valve is regulated for opening at a pressure inside the vessel which is appreciably lower than the pressure of the second fluid, the means of control consist of a three-way valve joining the first connecting conduit to the second connecting conduit and coupled to the vessel by a third connecting conduit, the three-way valve is regulated for closure of the first connecting conduit for the delivery of the first fluid and opening of the second connecting conduit for the delivery of the second fluid at a pressure inside the vessel which is appreciably lower than that of the second fluid, the means of control consist to comprise a nonreturn valve fitted in the first conduit for connecting the vessel to the delivery of the first fluid, and a bursting disc fitted in the second conduit for connecting the vessel to the delivery of the second fluid, the first fluid consists of a gas, for example a natural or synthetic gas of low boiling point, and the second fluid consists of a coolant gas.

BRIEF DESCRIPTION OF THE DRAWINGS

The invention will be better understood with the aid of the description which is to follow, given solely by way of example and referring to the attached drawings, in which.

DETAILED DESCRIPTION

Figure 1:
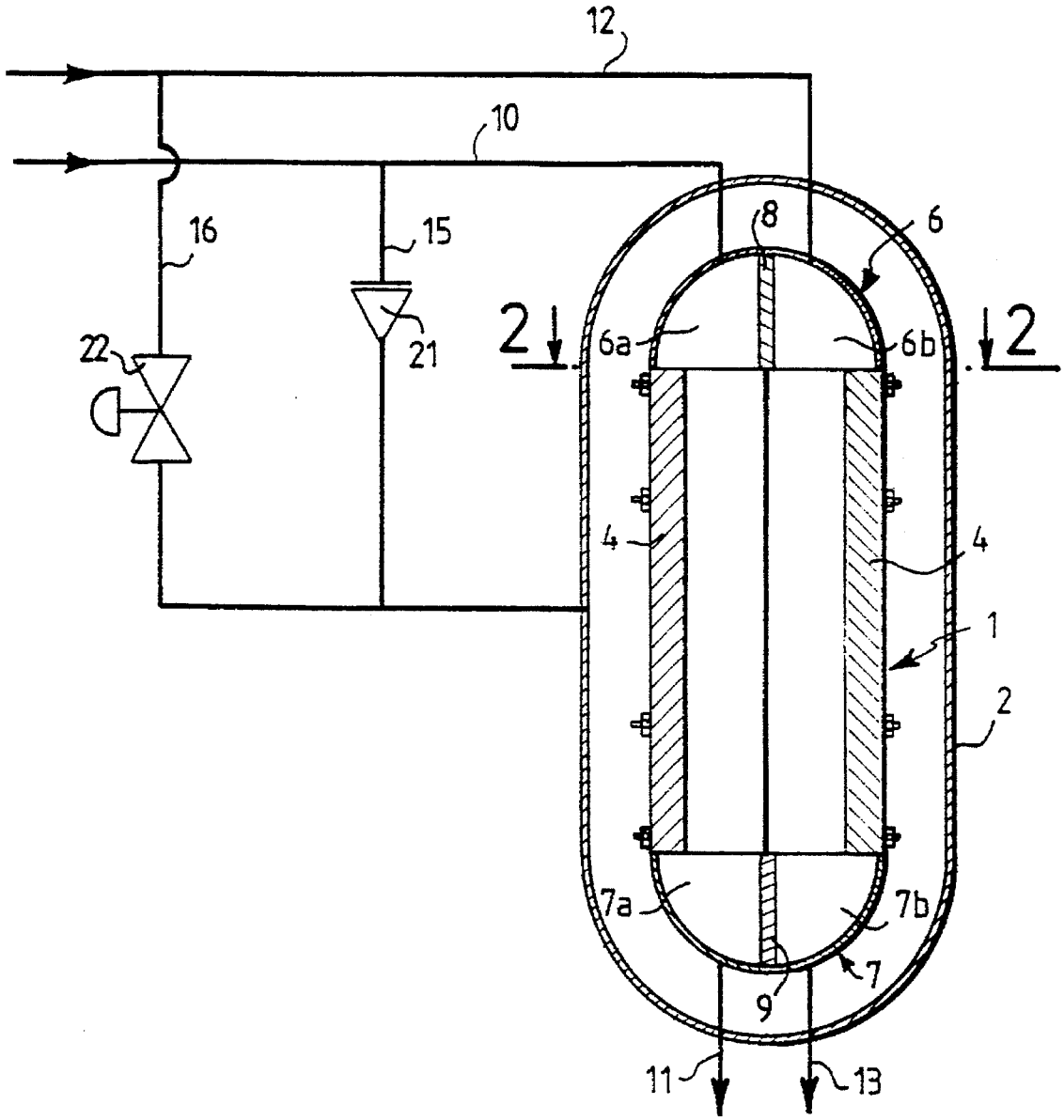
FIG. 1 is a schematic sectional view of a first embodiment of the system for pressurizing a plate bundle, according to the invention.
Figure 2:
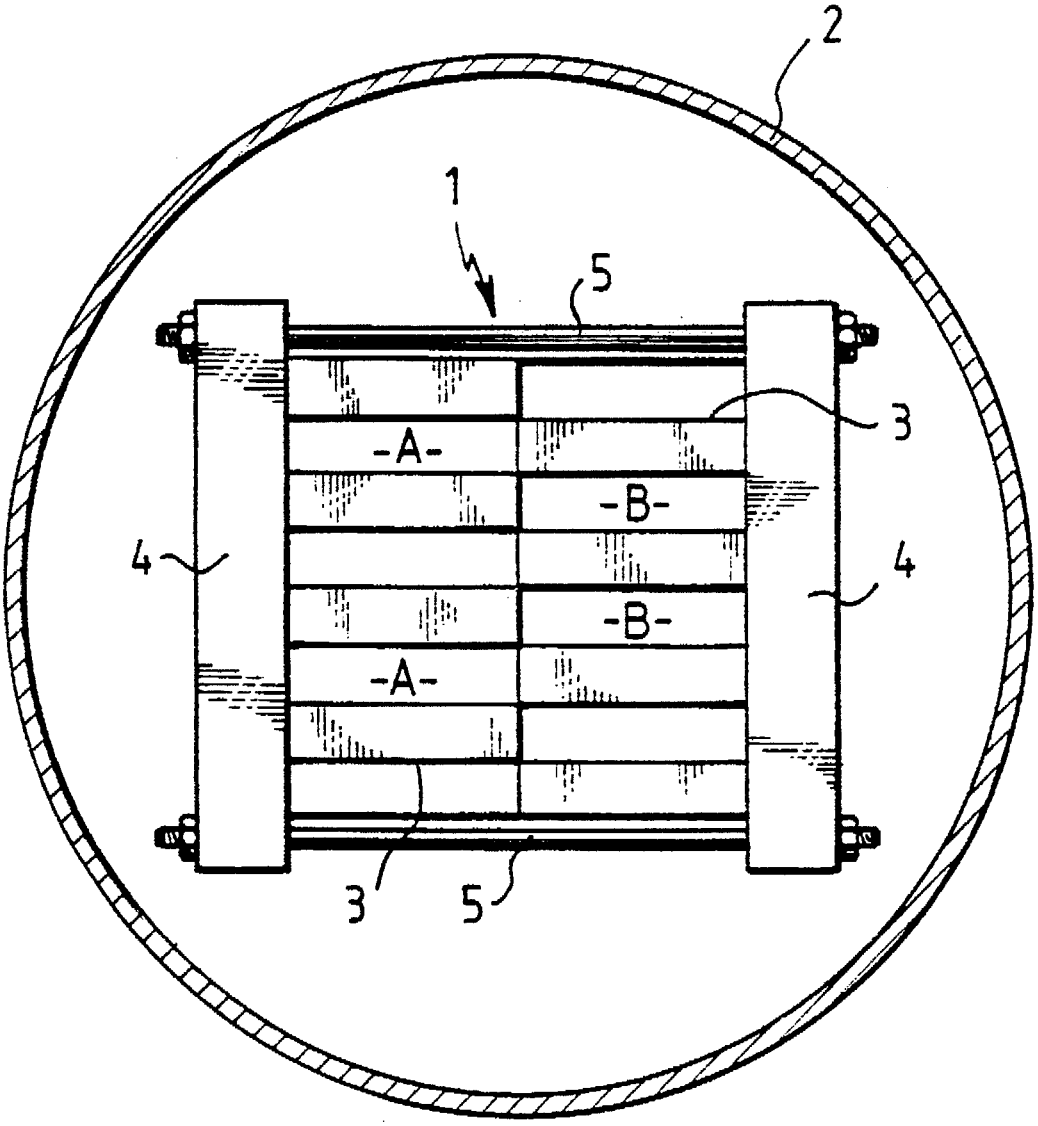
FIG. 2 is a view in section along the line 2—2 of FIG. 1.

FIGS. 1 and 2 illustrate schematically a plate bundle 1, especially for a plate heat exchanger intended, for example, for the liquefaction of natural or synthetic gas of low boiling point.

Plate bundle 1 is arranged in a leakproof vessel 2 and is made up of a multitude of metal plates 3 which are stacked and parallel to one another.

As shown in FIG. 2, the plate bundle 1 may be equipped with a mechanical pressurization system consisting of two thick plates 4 arranged on two opposed sides of the plate bundle 1 and connected to each other by tie-rods 5.

The tie-rods 5 may be equipped with dynamo-elastic rings (not shown), making it possible to compensate the differential expansion of the tie-rods 5 and of the plates 3 of the plate bundle 1.

These plates 3 form a first circuit A and a second circuit B, for example concurrent with the first circuit A.

At each of its ends, the plate bundle 1 comprises a header, 6 and 7 respectively.

The header 6 is divided into two compartments **6*a* and 6*b* by a partition 8, and the header 7 is also divided into two compartments 7*a* and 7*b* by a partition 9**.

A delivery conduit 10 for a first fluid such as, for example, a gas at a pressure of 50 bars, opens into the compartment **6*a* of the header 6 and communicates via the circuit A with the compartment 7*a* of the header 7, into which opens an exit conduit 11 for the cooled first fluid, i.e., the gas liquefied after its passage through the plate bundle 1**.

The conduit 11 is connected to a low-pressure receptacle (not shown), for collecting the liquefied gas.

Furthermore, a delivery conduit 12 for a second fluid such as, for example, a coolant fluid in gaseous phase at a pressure of 48 bars, opens into the compartment **6*b* of the header 6 and communicates via the circuit B with the compartment 7*b* of the header 7 into which opens an exit conduit 13 for the coolant liquid after its passage through the plate bundle 1**.

In order to assure the mechanical behavior of the plate bundle 1 under all operating conditions, i.e., during normal operation, the start-up, the shutdown and exceptional cases of operation, plate bundle 1 is equipped with an active or passive pressurizing device.

In what follows, the description will be given by designating a gas to be treated as first fluid and a coolant gas as second fluid, it being quite obviously possible to employ other fluids.

The pressurizing device includes a first conduit 15 for connecting the vessel 2 to the gas delivery conduit 10 continuously feeding this vessel 2 with gas to be treated under pressure, and a second conduit 16 for connecting the vessel 2 to the coolant gas delivery conduit 12, feeding the vessel 2 with coolant gas in case of stoppage of the feeding with gas to be treated.

The pressurizing device also comprises means for controlling the feeding of the vessel 2 with coolant gas in the case of a stoppage in the feeding of gas to be treated to vessel 2.

According to a first embodiment, shown in FIG. 1, the means for controlling the feeding of the vessel 2 with coolant gas consist of a nonreturn valve 21 fitted in the first conduit 15 for connecting the vessel 2 to the delivery conduit 10 for gas to be treated, and of a controlled valve 22 fitted in the second conduit 16 for connecting the vessel 2 to the delivery conduit 12 for coolant gas.

The controlled valve 22 is regulated for an opening at an internal vessel pressure which is appreciably lower than that of the coolant liquid, for Example 1 bar lower.

In normal operation, the controlled valve 22 is closed and the pressurizing of the plate bundle 1 is carried out by feeding the interior of the vessel 2 with gas to be treated at a pressure of approximately 50 bars by means of the conduit 15 and of the nonreturn valve 21.

In the event of stoppage in the feed of gas to be treated, the valve 22 controlled by the measurement of the differential in pressure between the interior of the vessel 2 and the coolant gas feed, opens to ensure the pressurizing of the plate bundle 1 by feeding the vessel 2 with coolant gas via the conduit 16.

Figure 3:
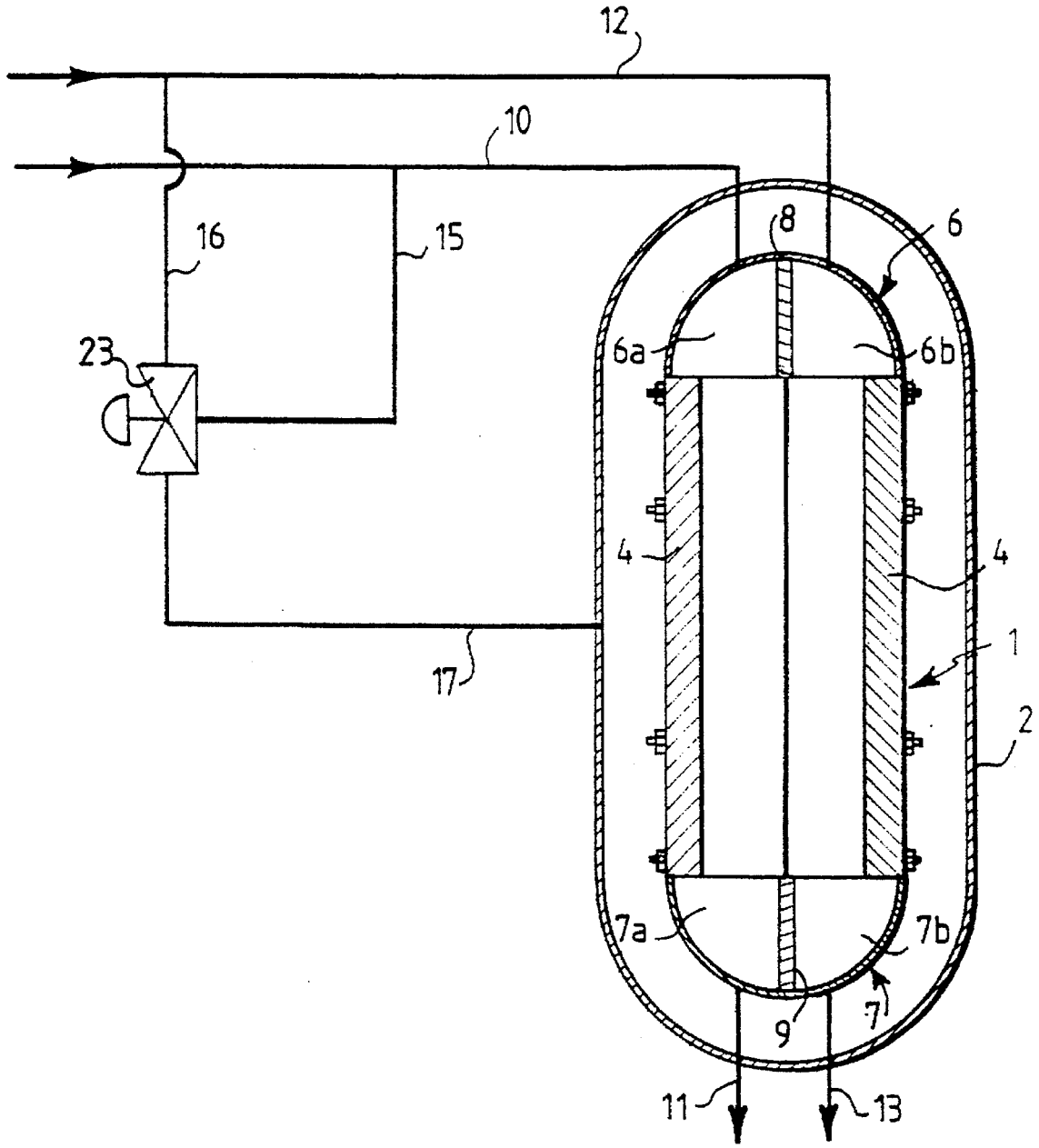
FIG. 3 is a schematic sectional view of a second embodiment of the system for pressurizing a plate bundle, according to the invention.

According to a second embodiment, shown in FIG. 3, the means of control 20 consist of a three-way valve 23 joining the first connecting conduit 15 to the second connecting conduit 16 and coupled to the vessel 2 by a third connecting conduit 17.

The three-way valve 23 is regulated for a closure of the first connecting conduit 15 for the delivery of the gas to be treated and an opening of the second connecting conduit 16 for the delivery of the coolant gas at an internal pressure in the vessel 2 which is appreciably lower than that of the coolant liquid.

In normal operation the three-way valve 23 puts the interior of the vessel 2 in communication with the conduit 10 for delivery of gas to be treated under pressure by means of the connecting conduits 15 and 17.

The three-way valve 23 shuts off the connecting conduit 16 connected to the coolant gas delivery conduit 12.

In the event of stoppage in the feed of gas to be treated, the three-way valve 23 closes the conduit 15 and opens the conduit 16 for feeding the interior of the vessel 2 with coolant gas by means of the conduit 17.

Figure 4:
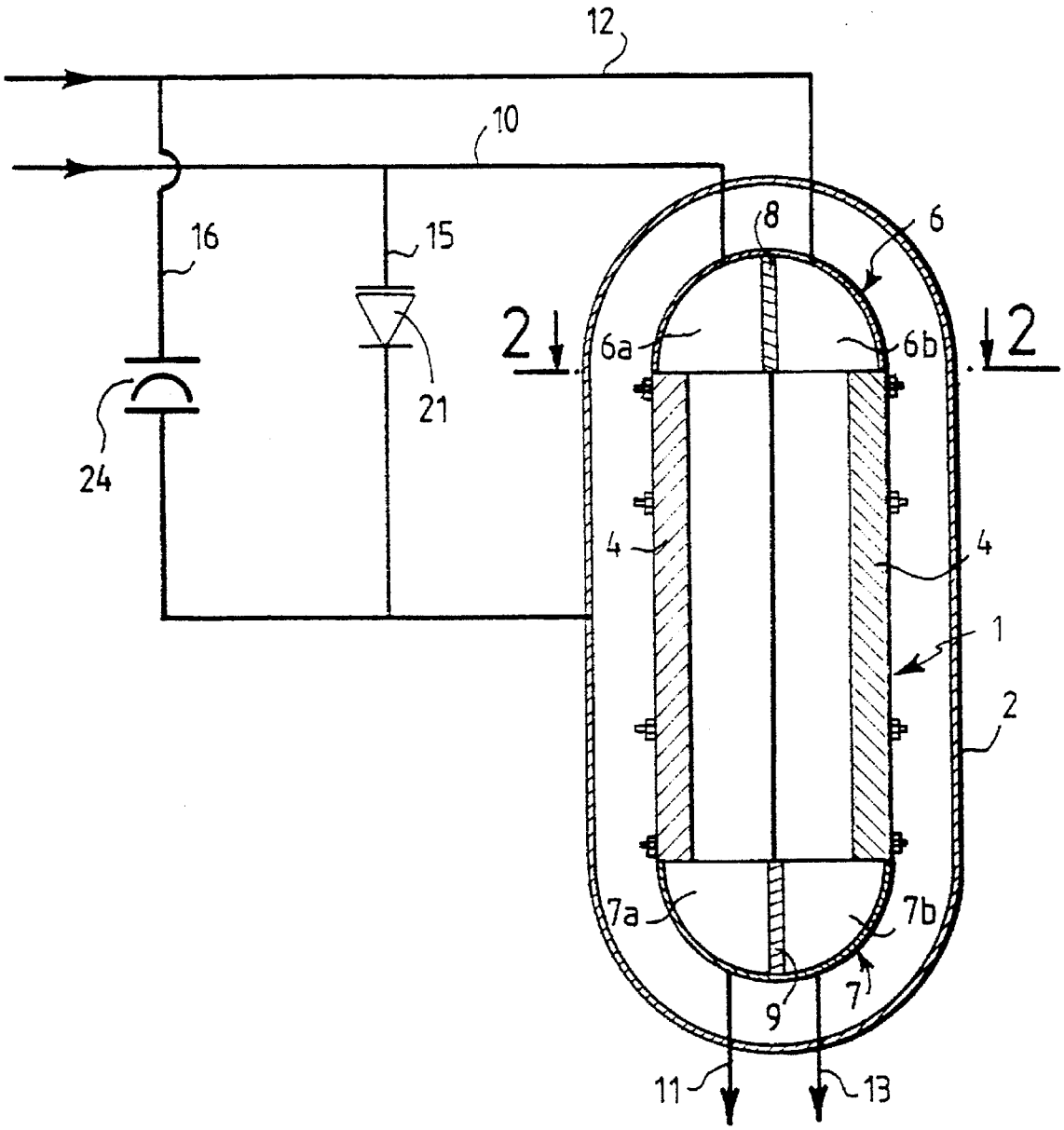
FIG. 4 is a schematic sectional view of a third embodiment of the system for pressurizing a plate bundle, according to the invention.

According to a third embodiment, shown in FIG. 4, the control means consist of a nonreturn valve 21 fitted in the first conduit 15 for connecting the vessel 2 to the conduit 10 for delivery of gas to be treated under pressure, and of a bursting disc 24 fitted in a second conduit 16 for connecting the vessel 2 to the coolant gas delivery conduit 12.

In the event of stoppage in the feeding of the interior of the vessel 2 with gas to be treated under pressure via the conduit 15, the bursting disc 24 opens and ensures the feeding of the interior of the vessel 2 with coolant gas via the conduit 16.

The pressurizing device according to the invention makes it possible, using simple and reliable means, to assure the mechanical behavior of the plate bundle under all operating conditions.

The pressurizing device according to the invention may be employed equally well for plate heat exchangers intended to cool or to heat a fluid, comprising a plate bundle for circulating concurrent or countercurrent fluids or with intercrossing streams.

We claim:

1. Device for pressurizing a plate bundle, especially for a plate heat exchanger, said plate bundle being arranged in a leakproof vessel and comprising a stack of metal plates which are parallel to one another to form a first circuit for circulating a first fluid under pressure and a second circuit for circulating a second fluid under pressure, said first fluid being at a pressure which is higher than the pressure of said second fluid, said device comprising a first conduit for connecting the vessel to a delivery of said first fluid continuously feeding said vessel, a second conduit for connecting said vessel to the delivery of said second fluid feeding said vessel in the event of stoppage of the feed of said first fluid, and means for controlling feeding of said vessel with said second fluid.

2. Device according to claim 1, wherein said means of control consist of a non return valve fitted in said first conduit for connecting said vessel to the delivery of said first fluid, and of a controlled valve fitted in said second conduit for connecting said vessel to the delivery of said second fluid.

3. Device according to claim 2, wherein said controlled valve is regulated for an opening at a pressure inside said vessel which is appreciably lower than the pressure of said second fluid.

4. Device according to claim 1, wherein said means of control consist of a three-way valve joining said first connecting conduit to said second connecting conduit and coupled to said vessel via a third connecting conduit.

5. Device according to claim 4, wherein said three-way valve is regulated for a closure of said first connecting conduit for the delivery of said first fluid and an opening of said second connecting conduit for the delivery of said second fluid at a pressure inside said vessel which is appreciably lower than the pressure of said second fluid.

6. Device according to claim 1, wherein said means of control consist of a non return valve fitted in said first conduit for connecting said vessel to the delivery of said first fluid, and of a bursting disc fitted in said second conduit for connecting said vessel to the delivery of said second fluid.

7. Device according to claim 1, wherein said first fluid is a gas.

8. Device according to claim 7, wherein said gas has a low boiling point.

9. Device according to claim 1, wherein said second fluid is a coolant gas.

* * * * *